United States Patent [19]

Densmore

[11] Patent Number: 4,807,406

[45] Date of Patent: Feb. 28, 1989

[54] SELF-CLEANING GUTTER

[76] Inventor: John Densmore, 15 Cheryl La., Carver, Mass. 02330

[21] Appl. No.: 141,215

[22] Filed: Jan. 6, 1988

[51] Int. Cl.[4] ..... E04D 13/00

[52] U.S. Cl. ..... 52/11; 52/12

[58] Field of Search ..... 52/11, 12

[56] References Cited

U.S. PATENT DOCUMENTS

| | | | |
|---|---|---|---|
| 1,141,204 | 6/1915 | Noce | 52/11 |
| 4,116,008 | 9/1978 | Ward | 52/11 |
| 4,117,635 | 10/1978 | Nelson | 52/11 |
| 4,411,108 | 10/1983 | Kerester | 52/11 |
| 4,446,658 | 5/1984 | Gouin | 52/11 |
| 4,696,131 | 9/1987 | Schreffler | 52/11 |

FOREIGN PATENT DOCUMENTS

| | | | |
|---|---|---|---|
| 44510 | 11/1927 | Norway | 52/11 |

*Primary Examiner*—Henry E. Raduazo

*Attorney, Agent, or Firm*—John P. McGonagle

[57] ABSTRACT

A self-cleaning gutter system formed from two, horizontal, longitudinal halves interlocked along the gutter bottom longitudinal axis. The back half, immediately adjacent to the house or building is fixedly attached thereto. At either end of the gutter a piece transverse to the gutter's longitudinal axis protrudes from the ends of the gutter half fixedly attached to the house or building. A rod is positioned within the gutter along the gutter's longitudinal axis protruding at either end of the gutter through the transverse piece. The front half of the gutter has arms extending therefrom which are journaled to the rod. A gearing system attached to said protruding end engages an actuator shaft which extends vertically to ground level. The ground end of the vertical shaft is journaled to a simple geared handle. The operation of the handle will cause the front half of the gutter to open 180°, thereby dumping debris, ice and snow to the ground.

14 Claims, 3 Drawing Sheets

SELF-CLEANING GUTTER

BACKGROUND OF THE INVENTION

This invention relates to a gutter system for houses or buildings, and more particularly to a gutter system which may be emptied remotely.

Gutter systems on houses and buildings are hampered by the accumulation of debris, such as leaves, roofing material silt, etc., which clog the gutters and hamper their performance in the orderly conduction of water from the roof of the house or building. The accumulation of such debris clogs the gutters and downspouts, and the water which is normally conducted therethrough overflows down the side of the building which can cause rot and mildew damage. Another difficulty is experienced when freezing weather tends to pile up ice and snow in the gutters to the extent that water run-off is impeded rather than assisted, resulting in leakage through the roof to the interior, and gradual rotting of the roof material and inner structure. The undue weight of the ice is also likely to damage the gutter itself, and seriously weaken its attachment to the building.

Various methods have been used for the cleaning of gutters. The most common of which is to do so manually from a ladder or from the roof on which the gutter is mounted, where the roof has a shallow pitch. Both methods are inconvenient and often dangerous to the home or building owner. Inexperience, uneven footing for tall ladders, slippery roofing or lose shingles, and insect nests, such as hornets and wasps, can make such manual cleaning an unpleasant and hazardous undertaking.

Screens and other guards have been mounted over gutters in an attempt to prevent such debris from being deposited therein. However, in actual practice debris still finds its way into the gutters, especially roofing material silt; the screens become clogged or covered over with leaves; they become rusty or otherwise become disconnected from the gutters; and they hamper manual attempts to clean the gutters where the screens are clogged or covered over.

The prior art has various gutter systems that have proposed clearing debris by dumping. Typical of those proposed include U.S. Pat. Nos. 4,669,232; 4,226,057; 4,117,635; 4,072,285; 4,061,151; 3,630,473; 3,507,078; 3,091,055; 1,141,204; 984,716; 531,989; and 510,515. All propose some type of system which manipulates the entire gutter to dump debris out. The systems proposed are complicated, difficult to install and are generally unstable by not being directly connected to the house or building.

SUMMARY OF THE INVENTION

It is a principal object of the present invention to provide a gutter system for a house or building which may be easily cleared of debris by dumping.

A further object of the present invention is to provide a new and novel gutter system which alleviates the aforesaid problems.

A still further object of this invention is to provide a new and novel dumpable gutter system which is easily installed and which is easy to operate.

In carrying out this invention in one illustrative embodiment thereof, a gutter is formed from two halves interlocked along the gutter bottom longitudinal axis. The back half, immediately adjacent to the house or building is fixedly attached thereto. At either end of the gutter a piece transverse to the gutter's longitudinal axis protrudes from the ends of the gutter half fixedly attached to the house or building. A rod is positioned within the gutter along the gutter's longitudinal axis protruding at either end of the gutter through the transverse piece. The front half of the gutter has arms extending therefrom which are journaled to the rod. A gearing system attached to said protruding end engages an actuator shaft which extends vertically to ground level. The ground end of the vertical shaft is journaled to a simple geared handle. The operation of the handle will cause the front half of the gutter to open 180°, thereby dumping debris, ice and snow to the ground.

Other and further objects, as well as various advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described a preferred embodiment of the invention.

DETAILED DESCRIPTION OF THE INVENTION

Figure 1:
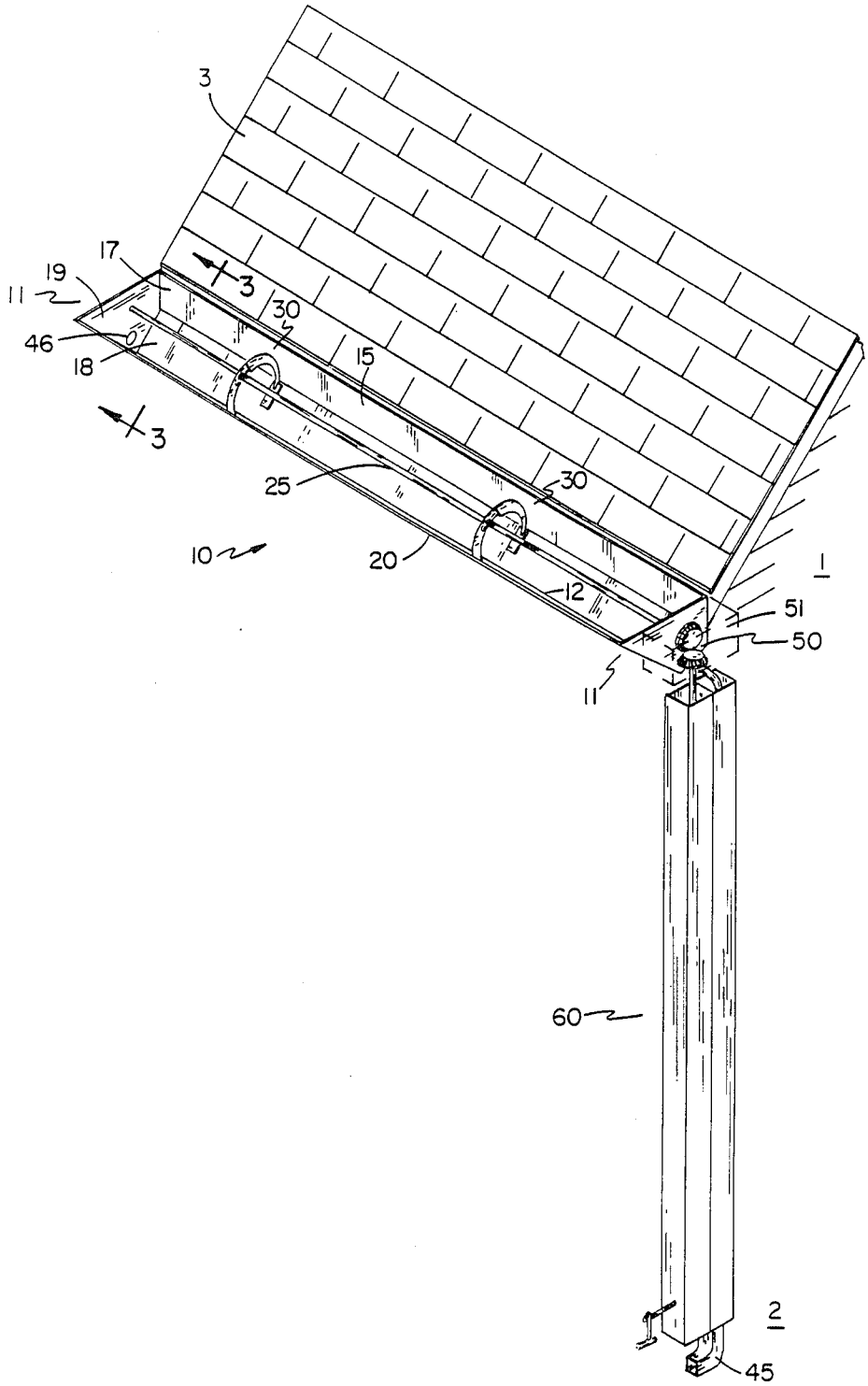
FIG. 1 is a perspective view of one embodiment of the invention.
Figure 2:
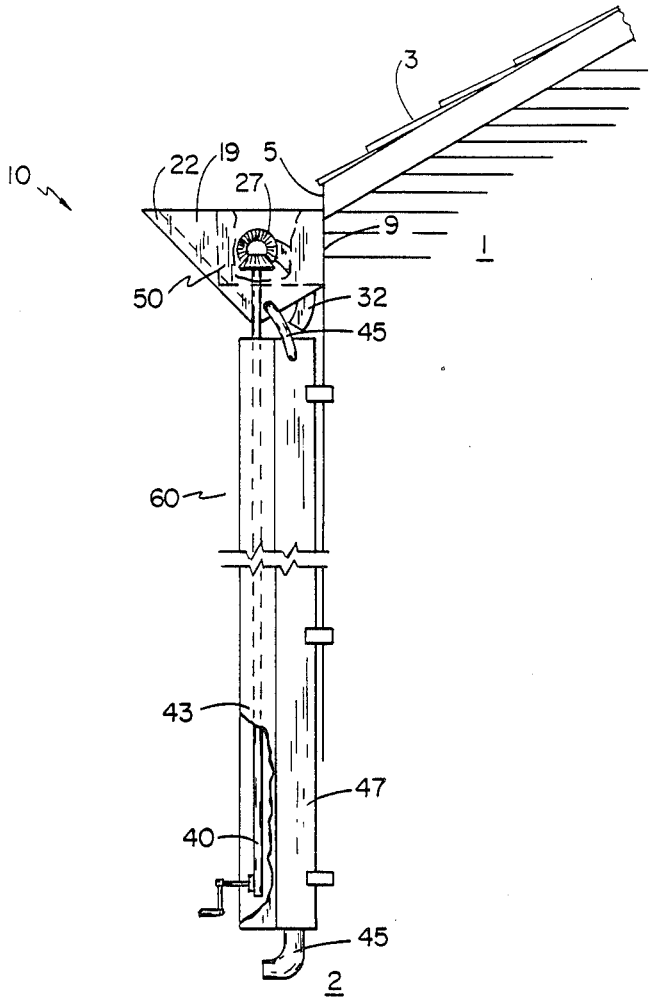
FIG. 2 is a side elevational view, partly in section, of the embodiment illustrated in FIG. 1.
Figure 3:
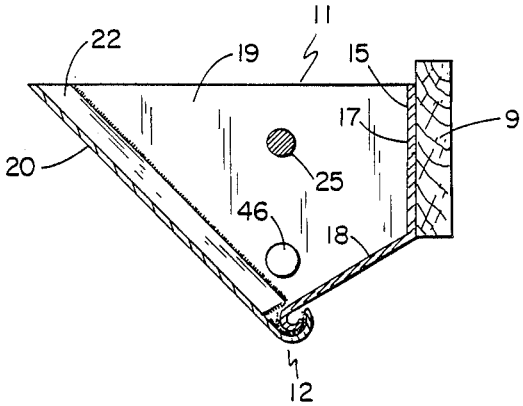
FIG. 3 is a cross-sectional view of the invention along the line 3—3 of FIG. 1.
Figure 4A:
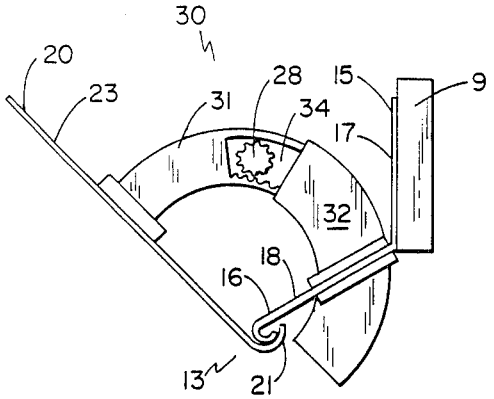
FIGS. 4A and 4B are sectional views of the bracket assemblies closed and opened.
Figure 4B:
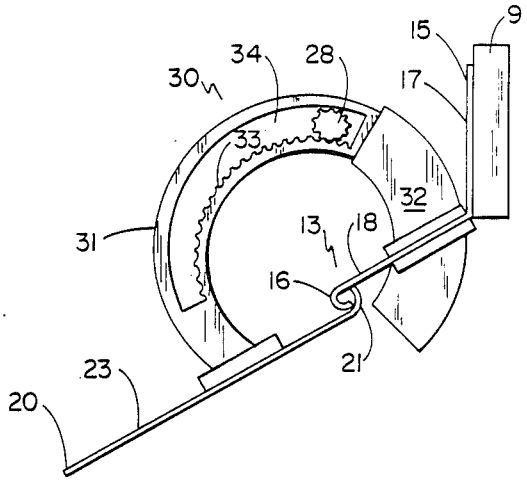
Figure 5:
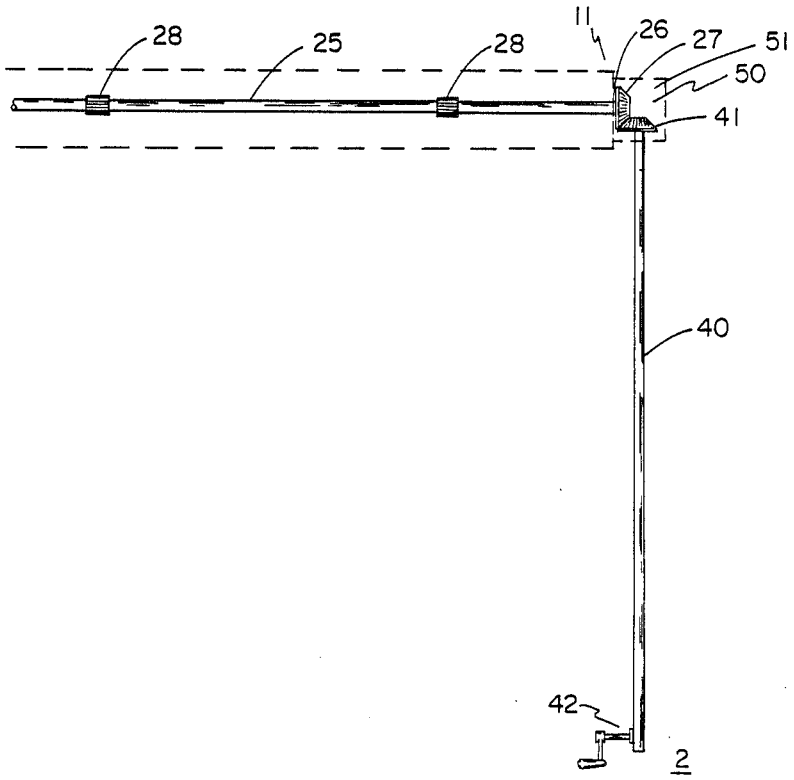
FIG. 5 is a sectional view of the rod and actuator shaft assemblies.

Referring to the drawings in detail wherein like numerals indicate, like elements, reference numeral 10 refers to one embodiment of the self-cleaning gutter system of the present invention. The gutter system 10 is horizontally mounted on a facia board 9 connected to a house or building 1 beneath the eave 5 of a roof 3. The gutter 10 is comprised of two longitudinal halves, a back half designated as the facia section 15 and a front half designated as the outside section 20, both horizontally positioned beneath the roof eave 5. The facia section lower edge 16 is curved backward toward the facia board 9. The outside section lower edge 21 is also curved backward toward the facia board 9. The facia section 15 and outside section 20 are joined together along their lower edges 16 and 21 such that the curved facia section lower edge 16 fits snugly within the curved outside section lower edge 21, forming a continuous hinge 13 along the gutter bottom 12. The facia section 15 is horizontally formed along its longitudinal axis into two portions. The upper portion 17 lies in a generally vertical plane and lies generally flat against the facia board 9 where it is fixedly attached. The bottom portion 18 is bent forward and outwardly from the facia board 9 at an angle generally in the 30° to 45° range. The facia section lower edge 16 is the lower edge of the bottom portion 18. The outside section 20 is generally flat overall except for its lower edge 21. The outside section 20 lies in a plane at an approximate 45° angle with the plane of the facia section upper portion 17. At either end of the outside section 20 are flanges 22 perpendicular to the plane of the outside section 20 and projecting generally inward toward the building 1. At either end of the facia section 15 pieces 19 transverse to the facia section's longitudinal axis protrude outwardly from the house 1. The pieces 19 overlap the outside section flanges 22. The combination of both 19 and 22 form the gutter ends 11.

A rod 25 is positioned within the gutter 10, between the facia section 15 and the outside section 20, above the hinge 13. The rod 25 is held in place by bracket assemblies 30 and each end 26 of the rod 25 protrudes through the facia section protruding pieces 19. One of the rod ends 26 protruding through the piece 19 is formed into a gear wheel 27. An actuator shaft 40 with a gear wheel 41 at its end extends vertically downward from the gutter end 11 to near ground level 2. The rod gear wheel 27 and actuator shaft gear wheel 41 are meshed together forming a bevel gear 50 so that radial twisting of the actuator shaft 40 causes the rod 25 to turn on its radial axis. A wheel 42 or other means is attached to the actuator shaft 40 near ground level 2 for twisting the actuator shaft 40.

The bracket assemblies 30 both hold the rod 25 in place within the gutter 10, and also control the opening and closing of the gutter outside section 20. At the places on the rod 25 where the rod 25 engages the bracket assemblies 30 the rod 25 has machined knurled gears 28 formed concentrically about its surface circumference. Each bracket assembly 30 has two main parts. One part is a curved arm 31 fixedly attached at one end to the inside surface 23 of the gutter's outside section 20. The other part is a curved, sleeve-type housing 32 fixedly attached to and extending through the facia section bottom portion 18. The bracket assemblies 30 lie in radial planes about the rod 25 transverse to the longitudinal axis of the gutter 10. The unattached end of the curved arm 31 slideably fits into the curved housing 32. The curved arm 31 has an opening defined along its central axis and has gear teeth 33 along the upper or lower edges of the opening 34. The rod 25 is positioned through the bracket assembly arm opening 34 so that the rod's knurled gear 28 engages and meshes with the arm opening gear teeth 33. As a result of this arrangement, as the rod 25 is turned, the bracket arm 31 will move out of or into the bracket housing 32 causing the gutter outside section 20 to open or close accordingly, rotating about an axis formed by the hinge 13.

To avoid twisting stresses on the gutter outside section 20, having a bracket assembly 30 every ten feet or so is recommended. Weatherstripping between the outside section flange 22 and facia section protruding pieces 19, as well as between the facia section lower edge 16 and outside section lower edge 21 is recommended for water tightness. The bevel gear 50 is enclosed in a self-lubing housing 51, grease packed, etc., for protection from weather elements and long life. A downspout arrangement 45 is attached to the gutter system 10 via an opening drain 46 in the protruding pieces 19 near to the hinge 13. Although a small level of water may remain in the gutter 10 near to the hinge 13 after a rain fall, the water will quickly evaporate. The actuator shaft 40 could be enclosed in a double channeled duct 60 extending from a gutter end 11 to ground level 2 where one channel 43 contains the actuator shaft 40 and the other channel 47 handles the downspout arrangement.

It is understood that the above-described embodiment is merely illustrative of the application. Other embodiments may be readily devised by those skilled in the art which will embody the principles of the invention and fall within the spirit and scope thereof.

I claim:

1. A self-cleaning gutter system for a house or building which may be easily cleaned of debris remotely, comprising:

a horizontal gutter formed from two longitudinal halves, a front half and a back half, wherein said two halves are interlocked along the gutter bottom longitudinal axis;

a rod positioned within the gutter along the gutter's longitudinal axis between said halves, above said gutter bottom;

a plurality of bracket assemblies interconnecting said gutter halves and engaging said rod, whereby said assemblies open and close as said rod is axially rotated in one direction or another; and an actuator shaft gearingly engaged at one end with a protruding end of said rod and extending vertically downward near to ground level, and having means by which the shaft may be rotated about its radial axis, whereby radial twisting of the actuator shaft causes said rod to turn on its radial axis.

2. A gutter system as recited in claim 1 wherein:

said back half is immediately adjacent to the house or building and is fixedly attached thereto.

3. A gutter system as recited in claim 2 wherein:

said back half has a piece at either end transverse to the gutter's longitudinal axis protruding outwardly from said house or building.

4. A gutter system as recited in claim 3 wherein:

said rod protrudes at either end through said transverse pieces before gearingly engaging said actuator shaft.

5. A gutter system as recited in claim 4 wherein:

said front half has a flange at either end transverse to the gutter's longitudinal axis protruding inwardly toward said house or building.

6. A gutter system as recited in claim 5 wherein:

said transverse pieces overlap said flanges and the combination form the gutter ends.

7. A gutter system as recited in claim 6 wherein:

said halves each have horizontal lower edges curved backward toward said house or building wherein the back half lower edge fits snugly within the front half lower edge forming a continuous hinge along the gutter bottom.

8. A gutter system as recited in claim 7 wherein:

said back half is horizontally formed along its longitudinal axis into two portions, an upper portion and a bottom portion, whereby said upper portion lies in a generally vertical plane flat against said house or building and fixedly attached thereto, and said bottom portion is bent forward and outwardly from said house or building at an angle in the range of 30° to 45°.

9. A gutter system as recited in claim 8 wherein:

said bracket assemblies lie in radial planes about said rod transverse to the longitudinal axis of the gutter.

10. A gutter system as recited in claim 9 wherein:

each bracket assembly has two parts, a curved arm fixedly attached at one end to said gutter front half and a curved sleeve-type housing fixedly attached to and extending through said back half's bottom portion.

11. A gutter system as recited in claim 10 wherein:

the curved arm's unattached end slideably fits into said curved, sleeve-type housing.

12. A gutter system as recited in claim 11 wherein:

said curved arm has an opening defined along its central axis with upper and lower edges and has gear teeth along one of said edges of said opening.

13. A gutter system as recited in claim 12 wherein:

said rod has a knurled gear formed concentrically about its surface circumference at each place on the rod where said rod engages a bracket assembly.

14. A gutter system as recited in claim 13 wherein:

said rod is positioned through the bracket assembly arm opening so that the rod's knurled gear engages and meshes with the arm opening's gear teeth, such that as the rod is rotated about its radial axis said curved bracket arm will move out of or into the curved bracket housing causing the gutter front half to open or close accordingly, rotating about an axis formed along said continuous hinge.

* * * * *